US007954650B1

(12) United States Patent
Malik

(10) Patent No.: US 7,954,650 B1
(45) Date of Patent: Jun. 7, 2011

(54) WRENCH AND SOCKET ORGANIZING APPARATUS

(76) Inventor: Akram M. Malik, Azle, TX (US)

( * ) Notice: Subject to any disclaimer, the term of this patent is extended or adjusted under 35 U.S.C. 154(b) by 490 days.

(21) Appl. No.: 12/141,731

(22) Filed: Jun. 18, 2008

(51) Int. Cl.
*A47F 7/00* (2006.01)

(52) U.S. Cl. ..... 211/70.6

(58) Field of Classification Search ..... 211/197, 211/1.3, 196, 205, 165, 115, 70, 85.29; 206/373, 206/378, 377, 379, 6.1, 806
See application file for complete search history.

(56) References Cited

U.S. PATENT DOCUMENTS

| | | | | | |
|---|---|---|---|---|---|
| 1,078,729 | A | * | 11/1913 | Hill | 312/4 |
| 1,243,173 | A | * | 10/1917 | Hinckley | 211/62 |
| 4,121,720 | A | * | 10/1978 | Hayes | 211/113 |
| 4,266,835 | A | | 5/1981 | Schmidt | |
| 4,290,531 | A | * | 9/1981 | Lazarus, III | 211/85.29 |
| 4,325,486 | A | * | 4/1982 | Neal | 211/85.29 |
| 4,534,471 | A | * | 8/1985 | Zahn et al. | 211/39 |
| 4,739,885 | A | * | 4/1988 | Noland et al. | 206/553 |
| 4,865,194 | A | | 9/1989 | Decarie | |
| 5,344,012 | A | | 9/1994 | Matthews | |
| 5,379,885 | A | * | 1/1995 | Chen | 206/216 |
| 5,799,789 | A | | 9/1998 | Ritchie et al. | |
| 5,836,446 | A | * | 11/1998 | Varnom | 206/373 |
| D408,285 | S | | 4/1999 | Farve | |
| 6,105,768 | A | * | 8/2000 | Brown | 206/373 |
| 6,241,105 | B1 | * | 6/2001 | Pomper | 211/85.2 |
| 6,254,055 | B1 | * | 7/2001 | Lamberson, Jr. | 248/538 |
| 6,360,891 | B1 | * | 3/2002 | Rideout | 206/373 |
| 6,808,067 | B2 | | 10/2004 | Benatz et al. | |
| 7,686,250 | B2 | * | 3/2010 | Fortes et al. | 244/129.1 |
| 7,832,568 | B2 | * | 11/2010 | Wu | 211/85.29 |
| 2002/0190015 | A1 | * | 12/2002 | Dietrich | 211/70.6 |
| 2006/0065564 | A1 | | 3/2006 | McCarty et al. | |
| 2006/0065613 | A1 | * | 3/2006 | McKay | 211/85.2 |
| 2009/0008347 | A1 | * | 1/2009 | Bell | 211/61 |

* cited by examiner

*Primary Examiner* — Jennifer E. Novosad

(57) ABSTRACT

A wrench and socket organizing apparatus includes a base that has a top side and a bottom side. A post has a bottom end coupled to the top side. A plate has an upper surface and a lower surface. The plate is mounted on the post and the upper surface has a plurality of apertures therein positioned adjacent to a perimeter edge of the plate. A plurality of hook members is provided and each has a hook portion and a threaded portion. The threaded portion is removably extendable upwardly through one of the apertures to position a corresponding one of the hook portions between the plate and the base. A plurality of fasteners is provided. Each of the threaded portions receives one of the fasteners to releasably secure the threaded portions to the plate. Tools may be removably hung from the hook portions.

5 Claims, 6 Drawing Sheets

WRENCH AND SOCKET ORGANIZING APPARATUS

BACKGROUND OF THE INVENTION

1. Field of the Invention

The present invention relates to tool organizing devices and more particularly pertains to a new tool organizing device for assisting a person in organizing a plurality of tools and tool accessories and in particular for organizing and storing a plurality of wrenches and sockets.

2. Summary of the Invention

The present invention meets the needs presented above by generally comprising a base that has a top side, a bottom side and a peripheral edge. A post has a top end and a bottom end. The bottom end is coupled to and extends upwardly from the top side. A plate has an upper surface and a lower surface. The plate is mounted on the post and the plate is horizontally oriented. The upper surface has a plurality of apertures therein positioned adjacent to a perimeter edge of the plate. A plurality of hook members is provided and each has a hook portion and a threaded portion. The threaded portion is removably extendable upwardly through one of the apertures to position a corresponding one of the hook portions between the plate and the base. A plurality of fasteners is provided. Each of the threaded portions receives one of the fasteners to releasably secure the threaded portions to the plate. Tools may be removably hung from the hook portions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
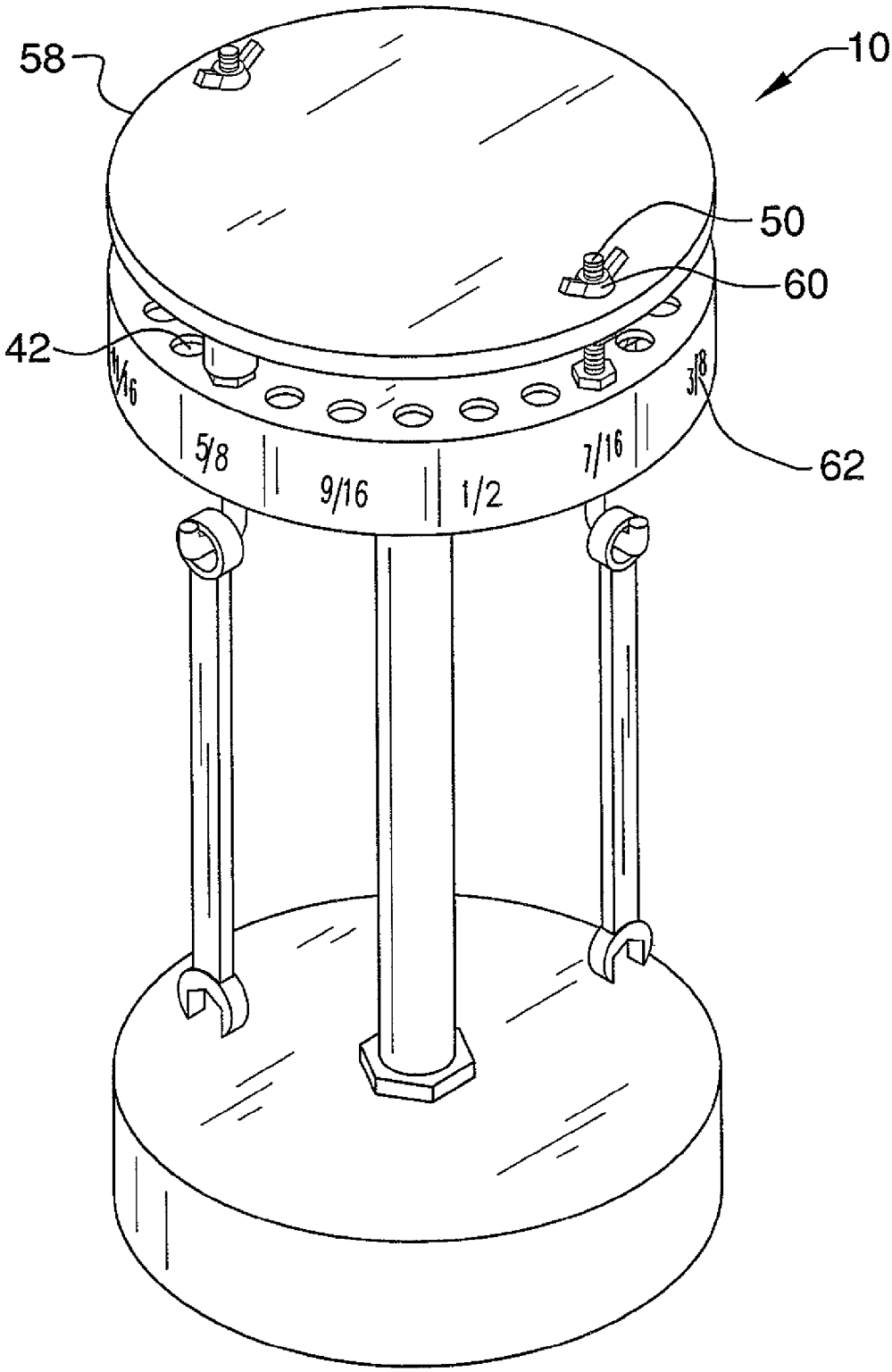
FIG. 1 is a front perspective view of a wrench and socket organizing apparatus according to the present invention.
Figure 2:
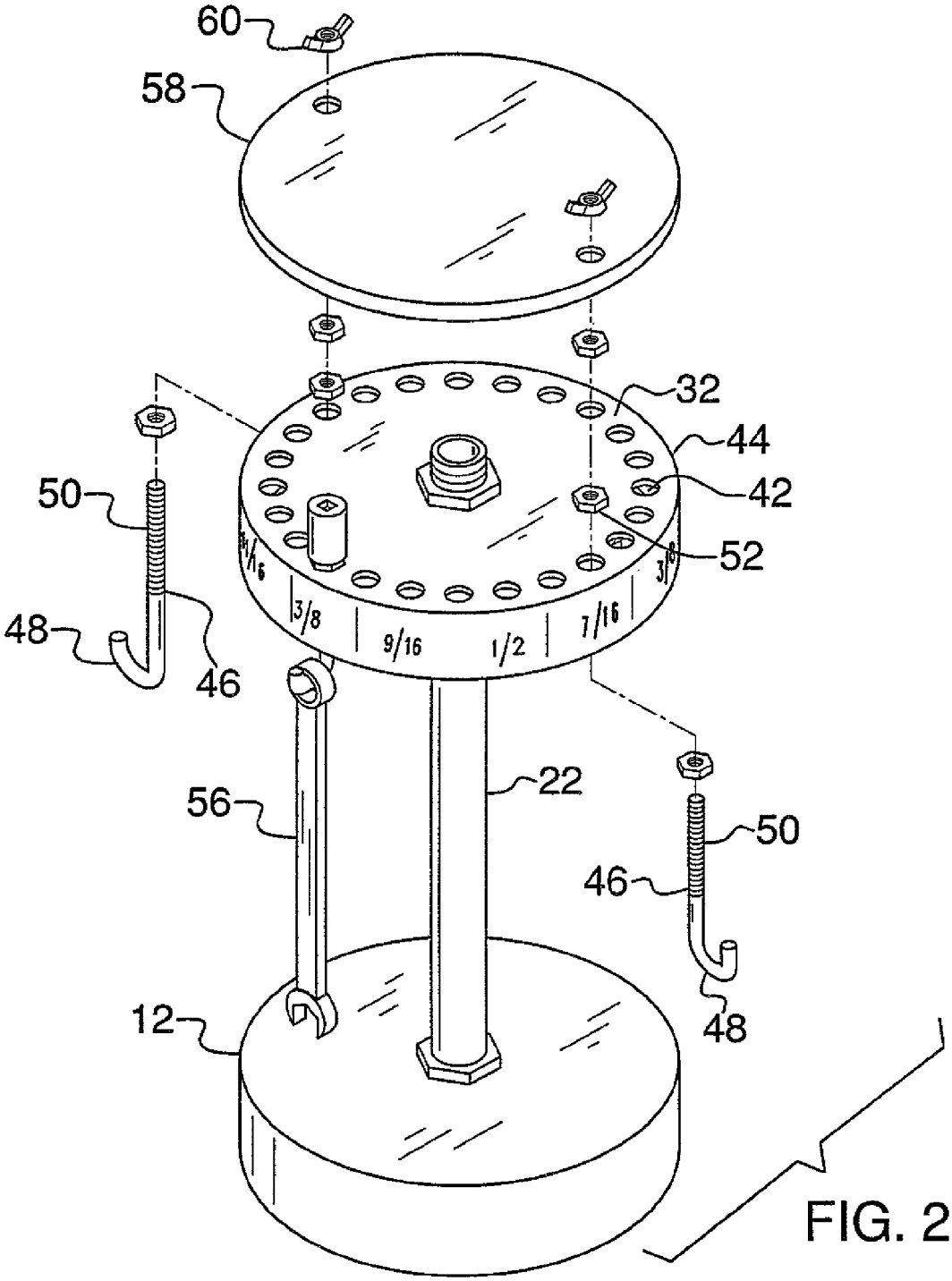
FIG. 2 is an expanded front perspective view of the present invention.
Figure 3:
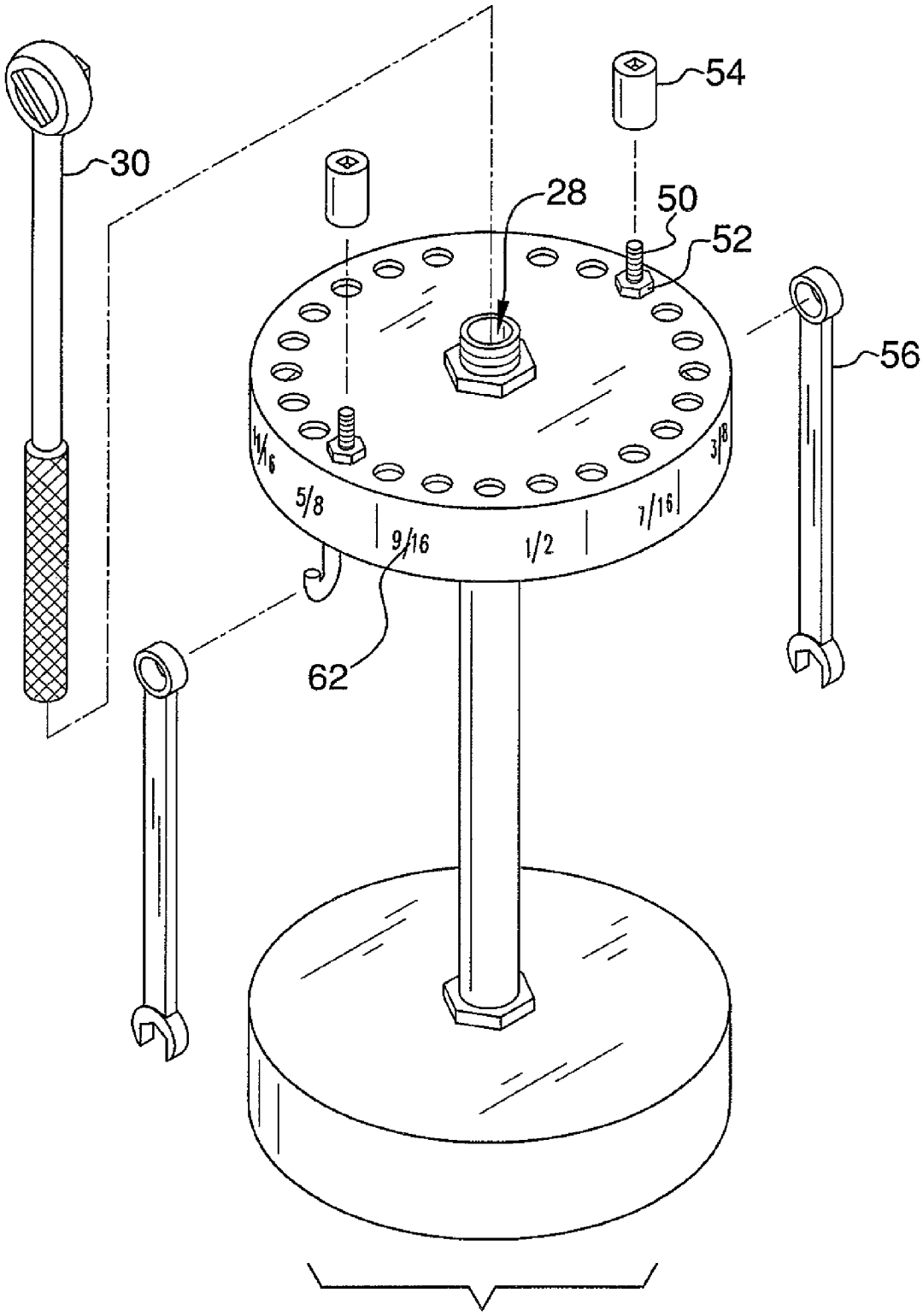
FIG. 3 is an expanded front perspective view of the present invention.
Figure 4:
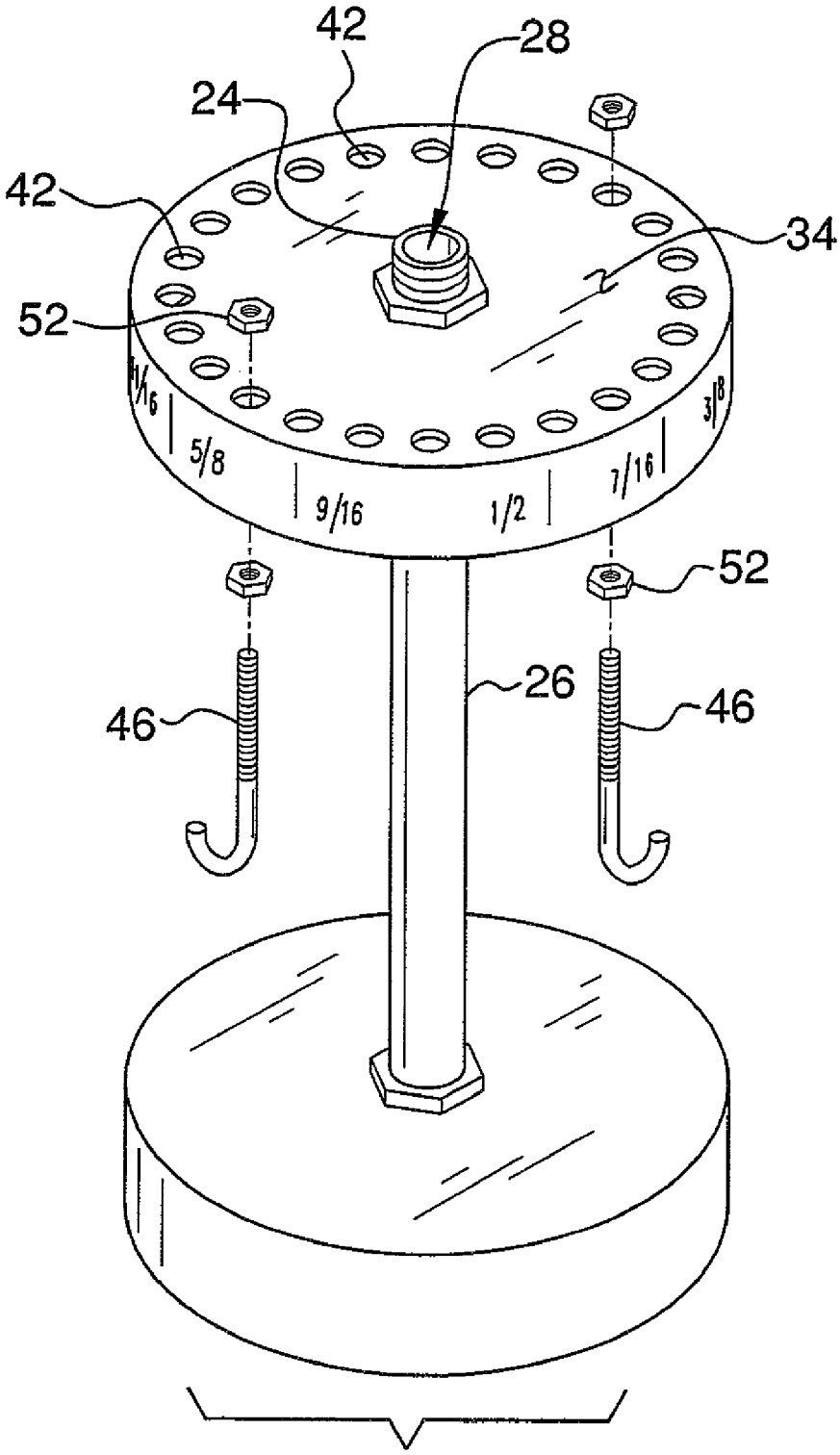
FIG. 4 is a front perspective view of the present invention.
Figure 5:
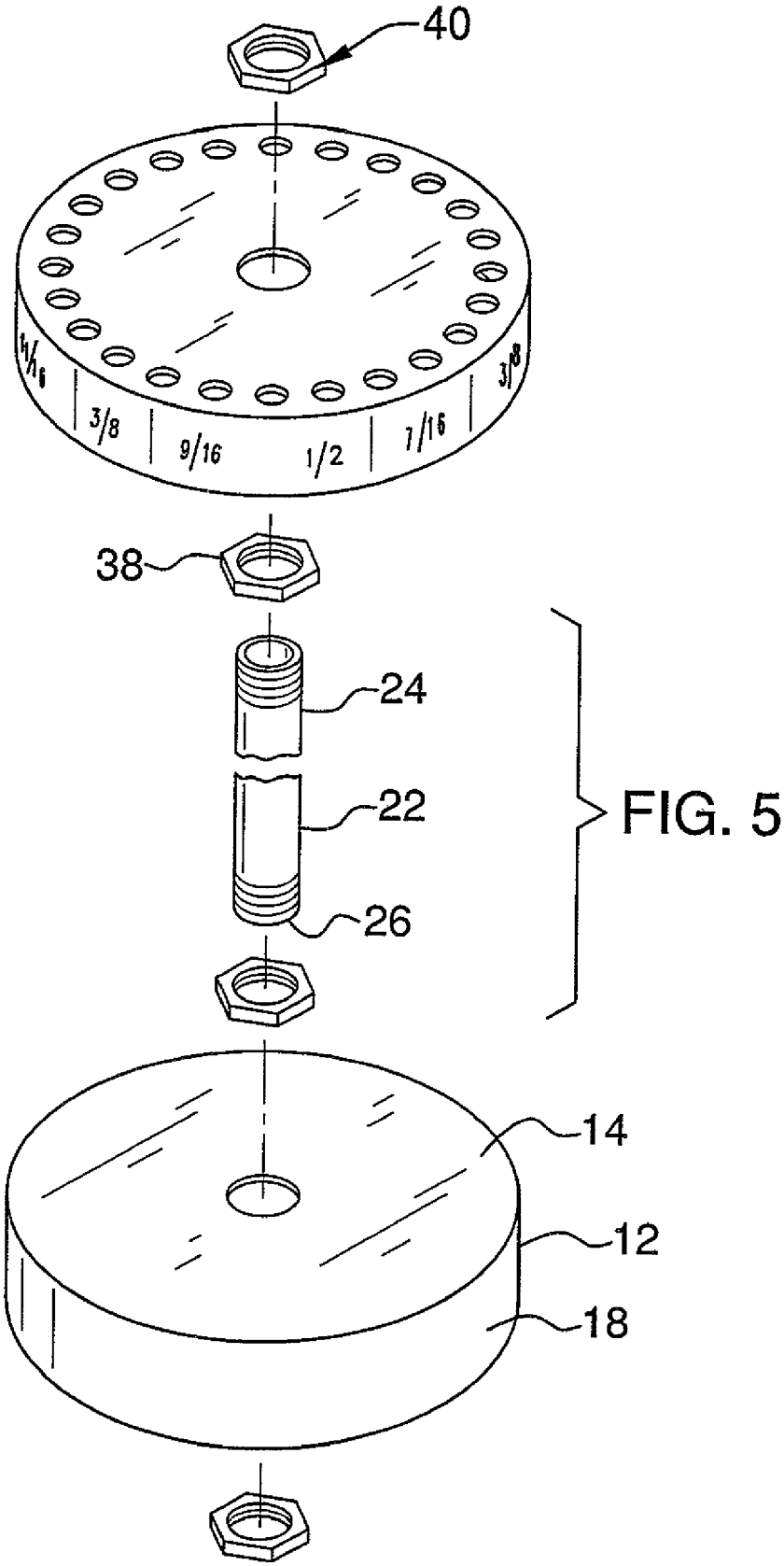
FIG. 5 is a front expanded perspective view of the present invention.
Figure 6:
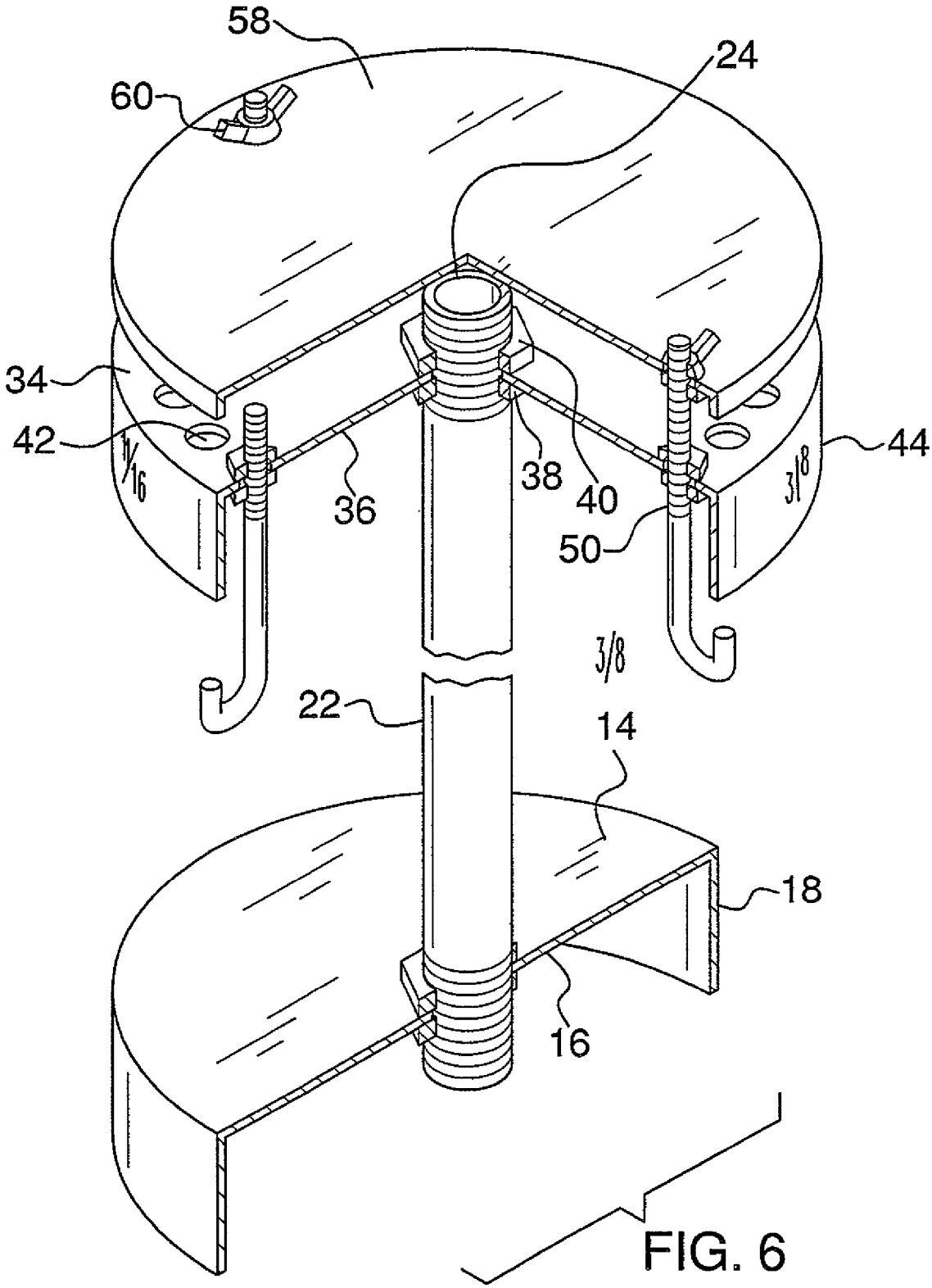
FIG. 6 is a broken front perspective view of the present invention.

With reference now to the drawings, and in particular to FIGS. 1 through 6 thereof, a new tool organizing device embodying the principles and concepts of the present invention and generally designated by the reference numeral 10 will be described.

As best illustrated in FIGS. 1 through 6, the wrench and socket organizing apparatus 10 generally comprises a base 12 that has a top side 14, a bottom side 16 and a peripheral edge 18. The peripheral edge 18 extends downwardly from the bottom side 16. A post 22 has a top end 24 and a bottom end 26. The bottom end 26 is coupled to and extends upwardly from the top side 14. The top end 24 has a well 28 therein. An elongated tool 30, such as a socket or ratcheting wrench, may be removably positioned in the well 28.

A plate 32 has an upper surface 34 and a lower surface 36. The plate 32 is mounted on the post 22 and the plate 32 is horizontally oriented. The post 22 may be extended through the plate 32 and the plate 32 rested on a flange 38, which may be formed by a nut threadably coupled to the post 22. A nut 40 may then be placed on the post 22 to secure the plate 32 between the nut 40 and the flange 38. The upper surface 34 has a plurality of apertures 42 therein positioned adjacent to a perimeter edge 44 of the plate 32.

A plurality of hook members 46 each has a hook portion 48 and a threaded portion 50. The threaded portion 50 of the hooks members 46 is removably extendable upwardly through one of the apertures 42 to position a corresponding one of the hook portions 48 between the plate 32 and the base 12.

A plurality of fasteners 52 is provided. Each of the threaded portions 50 receives one of the fasteners 52 to releasably secure the threaded portions 50 to the plate 32. The threaded portions 50 extend upwardly from an associated one of the fasteners 52 to form mounts. Sockets 54 may be removably positioned on the mounts and tools 56 may be removably hung from the hook portions 48. The tools 56 positioned on the hook portions 48 are typically wrenches.

A cover 58 is removably coupled to the plate 32 and is spaced from the plate 32. The cover 58 may be coupled to the plate 32 by extending the threaded portions 50 through the cover 58 and securing the threaded portions 50 with conventional fasteners 60 such as wing nuts.

As shown in the Figurers, perimeter edge 44 may include size indicia 62 for allowing better organization of the wrenches 56 and the sockets 54 wherein the sockets 54 and wrenches 56 are positioned on the apparatus 10 according to the size indicia being indicated adjacent to the threaded portion 50 or the hook portion 48 being used. This further increases the efficiency of the apparatus 10 because it allows a person to more quickly find the correct size of wrench 56 or socket 54 that they are looking for.

In use, the hook members 46 are coupled to the plate 32 as described above and as shown in the figures. The hook members 46 may be used for hanging wrenches and the like while sockets are held between the cover 58 and the plate 32 on the threaded portions 50. This allows a person to quickly access, transport tools as needed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wrench and socket organizing apparatus comprising:

a base having a top side, a bottom side and a peripheral edge;

a post having a top end and a bottom end, said bottom end being coupled to and extending upwardly from said top side;

a plate having an upper surface and a lower surface, said plate being mounted on said post and said plate being horizontally oriented, said plate having plurality of apertures therein extending through said upper surface and said lower surface, each of said apertures being positioned adjacent to a perimeter edge of said plate;

a plurality of hook members each having a hook portion and a threaded portion, said threaded portion being removably extendable upwardly through one of said apertures to position a corresponding one of said hook portions between said plate and said base;

a plurality of fasteners, each of said threaded portions receiving one of said fasteners to releasably secure said threaded portions to said plate, wherein tools may be removably hung from said hook portions; and size indicia being positioned on said perimeter edge to allow organizing the tools by size designations.

2. The apparatus according to claim 1, wherein said top end of said post has a well therein, and wherein an elongated tool may be removably positioned in said well.

3. The apparatus according to claim 1, wherein said threaded portions extend upwardly from an associated one of said fasteners to form mounts, and wherein sockets may be removably positioned on said mounts.

4. The apparatus according to claim 3, further including a cover being removably coupled to said plate and being spaced from said plate.

5. A wrench and socket organizing apparatus comprising:

a base having a top side, a bottom side and a peripheral edge;

a post having a top end and a bottom end, said bottom end being coupled to and extending upwardly from said top side, said top end having a well therein, wherein an elongated tool may be removably positioned in said well;

a plate having an upper surface and a lower surface, said plate being mounted on said post and said plate being horizontally oriented, said plate having a plurality of apertures therein extending through said upper surface and said lower surface, each of said apertures being positioned adjacent to a perimeter edge of said plate;

a plurality of hook members each having a hook portion and a threaded portion, said threaded portion being removably extendable upwardly through one of said apertures to position a corresponding one of said hook portions between said plate and said base;

a plurality of fasteners, each of said threaded portions receiving one of said fasteners to releasably secure said threaded portions to said plate, said threaded portions extending upwardly from an associated one of said fasteners to form mounts, wherein sockets may be removably positioned on said mounts and tools may be removably hung from said hook portions; and a cover being removably coupled to said plate and being spaced from said plate.

* * * * *